US009123514B2

(12) United States Patent
Campbell

(10) Patent No.: US 9,123,514 B2
(45) Date of Patent: Sep. 1, 2015

(54) IN SITU GENERATION OF OZONE FOR MASS SPECTROMETERS

(71) Applicant: DH Technologies Development Pte. Ltd., Singapore (SG)

(72) Inventor: John Lawrence Campbell, Milton, CA (US)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/369,259

(22) PCT Filed: Nov. 28, 2012

(86) PCT No.: PCT/IB2012/002531
§ 371 (c)(1),
(2) Date: Jun. 27, 2014

(87) PCT Pub. No.: WO2013/098604
PCT Pub. Date: Jul. 4, 2013

(65) Prior Publication Data

US 2014/0374591 A1 Dec. 25, 2014

Related U.S. Application Data

(60) Provisional application No. 61/580,507, filed on Dec. 27, 2011.

(51) Int. Cl.
*H01J 49/26* (2006.01)
*H01J 49/00* (2006.01)
*H01J 49/10* (2006.01)

(52) U.S. Cl.
CPC ..... *H01J 49/005* (2013.01); *H01J 49/10* (2013.01)

(58) Field of Classification Search
USPC ..... 250/281, 282, 283, 286, 287
See application file for complete search history.

(56) References Cited

U.S. PATENT DOCUMENTS

| | | | | |
|---|---|---|---|---|
| 4,437,958 | A * | 3/1984 | Rockwood et al. | 204/157.22 |
| 7,771,943 | B2 | 8/2010 | Blanksby et al. | |
| 2004/0157280 | A1 | 8/2004 | Wentworth et al. | |
| 2008/0047907 | A1 | 2/2008 | Herzog | |
| 2008/0296486 | A1 * | 12/2008 | Blanksby et al. | 250/282 |

FOREIGN PATENT DOCUMENTS

| | | |
|---|---|---|
| JP | 07-204258 | 8/1995 |
| JP | 2008-298582 | 12/2008 |
| KR | 10-2005-0001793 | 1/2005 |

OTHER PUBLICATIONS

International Search Report from International Patent Application No. PCT/IB2012/002531, dated Mar. 29, 2013.

* cited by examiner

*Primary Examiner* — Nicole Ippolito

(57) ABSTRACT

In some embodiments, a mass spectrometer capable of performing OzID is disclosed that can provide ozone in situ within an evacuated chamber of the spectrometer, e.g., within a collision cell or within the vacuum chamber of the mass spectrometer. In some embodiments, a corona discharge generated within the evacuated chamber can be employed to convert an ozone precursor delivered to the chamber into ozone.

6 Claims, 5 Drawing Sheets

1. Mass spectrometer
2. First mass spectrometer element
3. Ion/molecule reaction volume
4. Second mass spectrometer element
5. Ozone generator
6. Gas mixture containing a partial pressure of oxygen

IN SITU GENERATION OF OZONE FOR MASS SPECTROMETERS

RELATED APPLICATION

This application claims priority to U.S. provisional application No. 61/580,507 filed Dec. 27, 2011, which is incorporated herein by reference in its entirety.

FIELD

The present teachings relate to a device and method for in situ generation of ozone for use in OzID reactions in mass spectrometers.

INTRODUCTION

Mass Spectrometry (MS) is an analytical technique that measures the mass-to-charge ratio of charged particles. It is used for determining masses of particles, for determining the elemental composition of a sample or molecule, and for elucidating the chemical structures of molecules, such as peptides and other chemical compounds. Mass spectrometry comprises ionizing chemical compounds to generate charged molecules or molecule fragments and measuring their mass-to-charge ratios.

In a typical MS procedure, a sample is loaded onto the MS instrument, and undergoes vaporization. The components of the sample are then ionized by one of a variety of methods (e.g., by impacting them with an electron beam), which results in the formation of charged particles (ions). The ions are then separated according to their mass-to-charge ratio in an analyzer by electromagnetic fields. The ions are detected, usually by a quantitative method. Finally, the ion signal is processed into mass spectra A typical Mass Spectrometer instrument comprises three modules: (a) an ion source, which can convert sample molecules into ions (or, in the case of electrospray ionization, move ions that exist in solution into the gas phase); (b) a mass analyzer, which sorts the ions by their masses by applying electric and/or electromagnetic fields; and (c) a detector, which measures the value of an indicator quantity and thus provides data for calculating the abundances of each ion present.

The mass analyzer is typically housed in a high vacuum chamber (P=about $10^{-5}$ Torr to $10^{-3}$ Torr—sections can be differentially pumped). In some cases, the mass spectrometer can employ electric and/or electromagnetic fields to separate ionized compounds from each other based upon their mass-to-charge ratio (m/z).

The technique has both qualitative and quantitative uses. These include identifying unknown compounds, determining the isotopic composition of elements in a molecule, and determining the structure of a compound by observing its fragmentation. Other uses include quantifying the amount of a compound in a sample or studying the fundamentals of gas-phase ion chemistry (the chemistry of ions and neutrals in a vacuum). MS is now in very common use in analytical laboratories that study physical, chemical, or biological properties of a great variety of compounds.

Multiple stages of mass analysis separation can be accomplished with individual mass spectrometer elements separated in space or using a single mass spectrometer with the MS steps separated in time. In tandem mass spectrometry in space, the separation elements are physically separated and distinct, although there is a physical connection between the elements to maintain high vacuum. These elements can be sectors, quadrupoles, or time-of-flight mass spectrometers.

By doing tandem mass spectrometry in time, the separation is accomplished with ions trapped in the same place, with multiple ion manipulation steps taking place over a period of time. A quadrupole ion trap (linear or 3D) or an FT-ICR MS instrument can be used for such analyses. Trapping instruments can perform multiple steps of analysis, which is sometimes referred to as $MS^n$ (read as "MS to the n"). Often the number of steps, n, is not indicated, but occasionally the value is specified; for example $MS^3$ indicates three stages of analysis.

In a tandem in space mass spectrometer, such as a QTRAP® mass spectrometer, the analyzer can comprise three regions, quadrupole 1 (q1), quadrupole 2 (q2) and quadrupole 3 (q3), which are generally positioned in order along the length of the mass spectrometer. Two of the elements, quadrupole 1 (q1) and quadrupole 3 (q3) can be used to separate ions based upon their m/z ratios. They are normally held at ~$10^{-5}$ Torr. The third element labeled, quadrupole 2 (q2), can be an rf-only ion guide that is used to fragment the ions. This can be used for structure elucidation. The pressure in q2 can be typically ~$10^{-3}$ Torr. Ions pass through the length of the mass spectrometer and are detected after passing through q3.

Fragmentation of gas-phase ions in tandem mass spectrometry can occur between or within different stages of mass analysis. There are many methods used to fragment the ions and these can result in different types of fragmentation and thus different information about the structure and composition of the molecule.

Often, the ionization process is sufficiently violent to leave the resulting ions with sufficient internal energy to fragment within the mass spectrometer. If the product ions persist in their non-equilibrium state for a moderate amount of time before auto-dissociation this process is called metastable fragmentation. Nozzle-skimmer fragmentation refers to the purposeful induction of in-source fragmentation by increasing the nozzle-skimmer potential on usually electrospray-based instruments. Although in-source fragmentation allows for fragmentation analysis, it is not technically tandem mass spectrometry unless metastable ions are mass analyzed or selected before auto-dissociation and a second stage of analysis is performed on the resulting fragments. In-source fragmentation is often used in addition to tandem mass spectrometry (with post-source fragmentation) to allow for two steps of fragmentation in a pseudo $MS^3$-type analysis.

Post-source fragmentation is most often what is being used in a tandem mass spectrometry experiment. Energy can also be added to the ions, which are usually already vibrationally excited, through post-source collisions with neutral atoms or molecules, the absorption of radiation, or the transfer or capture of an electron by a multiply charged ion. Collision-induced dissociation (CID), also called collisionally activated dissociation (CAD), involves the collision of an ion with a neutral atom or molecule in the gas-phase, excitation of the ion, and subsequent dissociation of the ion.

Although mass spectrometers are very accurate at differentiating between most compounds, there are quite a number of compounds that can have both the same mass and the same mass to charge ratio (m/z). Such compounds cannot be properly differentiated using conventional mass spectrometry, and this is especially true in the case of molecules with one or more unsaturated bonds, like fatty acids, where molecules having the same mass and m/z can have very different chemical properties (e.g., omega-3 fatty acids and omega-6 fatty acids).

Methods have been developed wherein the position of unsaturated bonds in a compound can be determined using ozonolysis, specifically Ozone induced Dissociation (OzID).

SUMMARY

In some aspects, the applicant's teachings comprise a mass spectrometer system for determining the number(s) of and position(s) of carbon-carbon double bonds (CCDBs) in a compound, the system comprising: means for ionizing the compound to provide ions; means for selecting ions of a given mass-to-charge ratio; means for allowing the selected ions to react with ozone to provide ozone-induced dissociation fragment ions; means for mass analyzing and detecting the ozone induced fragment ions formed by the reaction means; and means for determining the position of CCDBs in the compound based on the difference between the mass-to-charge ratio of the ions selected by the selection means and the mass-to-charge ratio of one or more of the ozone-induced dissociation fragment ions formed from the selected ions once reacted with ozone, wherein the ozone is generated within the vacuum chamber of the mass spectrometer, at or near the location of the ion/molecule reaction volume.

In some embodiments, the applicant's teachings comprise: a first mass spectrometer element; a second mass spectrometer element; an ion/molecule reaction volume disposed between said elements; an ozone generator; and a gas source capable of introducing a gas mixture containing a partial pressure of oxygen to said ozone generator, wherein the first element, the second element, the reaction volume and the ozone generator are all housed in a high vacuum chamber and wherein the gas source is housed outside of the high vacuum chamber.

In some embodiments, a mass spectrometer is disclosed that can comprise a collision cell. The mass spectrometer further comprises a conduit for delivering to the collision cell a CAD gas (e.g., nitrogen, argon, etc.) as well as a precursor gas for generating ozone (e.g., oxygen) in situ within the vacuum chamber of the mass spectrometer. For example, the conduit can be coupled at its proximal end to a source of CAD gas as well as oxygen, wherein the gas sources are positioned external to the collision cell, to receive the CAD and the precursor gas and deliver them to the collision cell. A device for generating a corona discharge in the ozone precursor gas within the collision cell is also provided. For example, in some embodiments, an electrically conductive wire can extend along the conduit and have an exposed tip in the collision cell, e.g., in the vicinity of distal end of the conduit. A voltage can be applied to the wire, e.g., via its proximal end external to the collision cell, to generate a corona discharge as the ozone precursor gas flows over the exposed tip, as it enters, or after entry into the collision cell. The discharge can then convert the precursor gas (e.g., oxygen) into the ozone in situ within the collision cell. In some embodiments, the voltage to the wire can be turned off to extinguish the discharge at the CAD gas is delivered to the collision cell, e.g., before or after in situ generation of ozone.

In some embodiments, the ozone generator can comprise a corona discharge source such as a corona discharge tube.

In some embodiments, the applicants' teachings comprise a method for determining the number of and position of CCDBs in a compound, the method comprising: (i) ionizing the compound to provide ions; (ii) selecting ions of a given mass-to-charge ratio; (iii) allowing the selected ions to react with ozone to generate ozone-induced dissociation fragment ions; (iv) performing mass analysis and detection of the ozone-induced dissociation fragment ions formed in step (iii); and (v) determining the number of and position of CCDBs in the compound based on the difference between the mass-to-charge ratio of the ions selected in step (ii), and the mass-to-charge ratio of one or more of the ozone-induced dissociation fragment ions formed from the selected ions in step (iii), wherein the ozone is generated within a high vacuum chamber housing that also houses the reaction chamber.

In one embodiment the ozone reaction of the applicant's teachings is via corona discharge.

These and other features of the applicant's teachings are set forth herein.

DRAWINGS

The skilled person in the art will understand that the drawings, described below, are for illustration purposes only. The drawings are not intended to limit the scope of applicants' teachings in any way.

Figure 5:
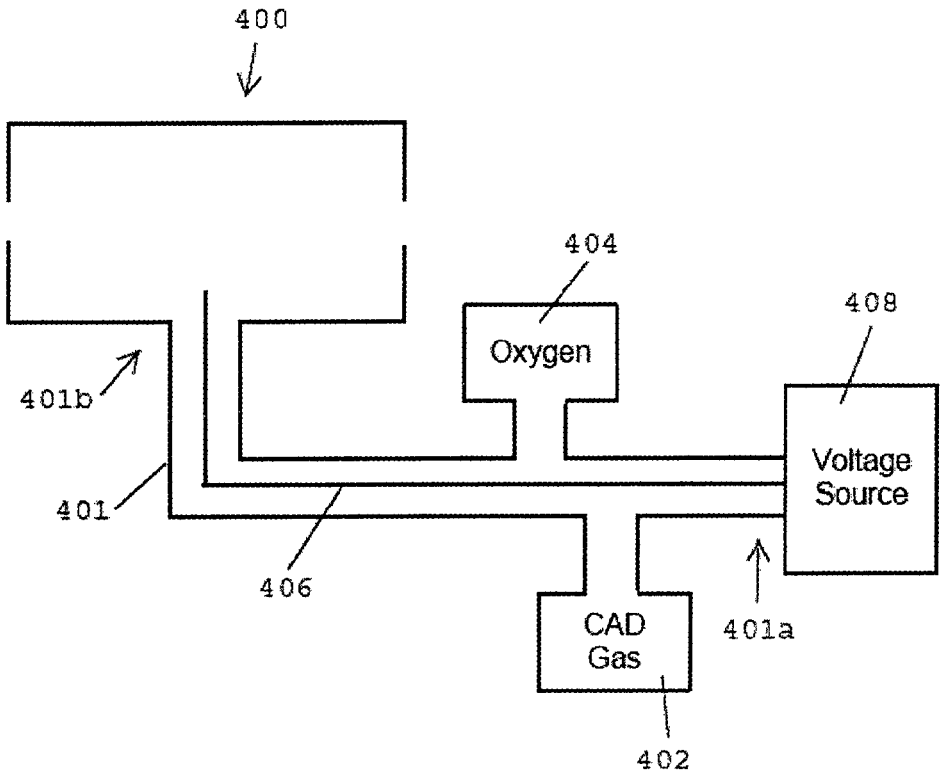

FIG. 5 schematically depicts a collision cell of a mass spectrometer according to an embodiment of the applicant's teachings in which ozone can be generated in situ.

DESCRIPTION OF VARIOUS EMBODIMENTS

Aspects of the applicants' teachings may be further understood in light of the following description, which should not be construed as limiting the scope of applicants' teachings in any way.

This disclosure is generally directed to an improved device and method for performing ozone-induced dissociation (OzID) in a mass spectrometer. A newly developed MS technique, termed OzID, uses ion/molecule reactions to elucidate the number of and position of carbon-carbon double bonds (CCDBs), e.g., on lipid ions. OzID requires the generation of ozone gas and introduction of this gas into a reaction volume within the mass spectrometer (e.g., q2 region of a QTRAP® mass spectrometer).

However, the current ozone generation workflow involves producing this reactive gas outside of a mass spectrometer's vacuum chamber and delivering the externally generated ozone to the chamber, which can add to the cost, complexity, and ultimately, the safety of an OzID-capable instrument.

Figure 1:
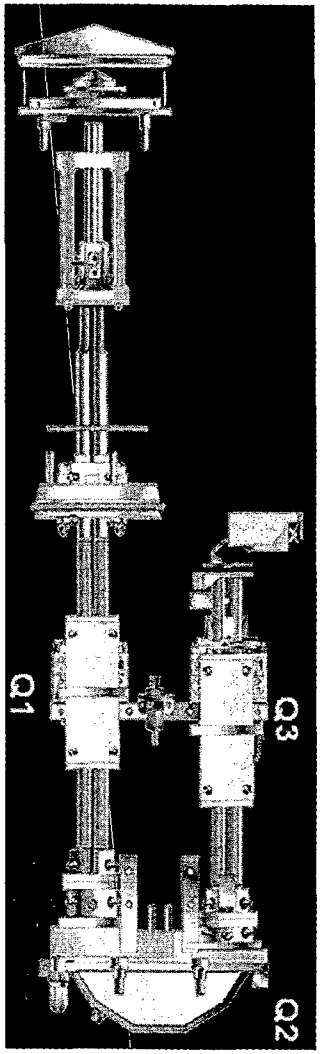
FIG. 1 is a schematic diagram of a QTRAP® Mass Spectrometer.
Figure 2:
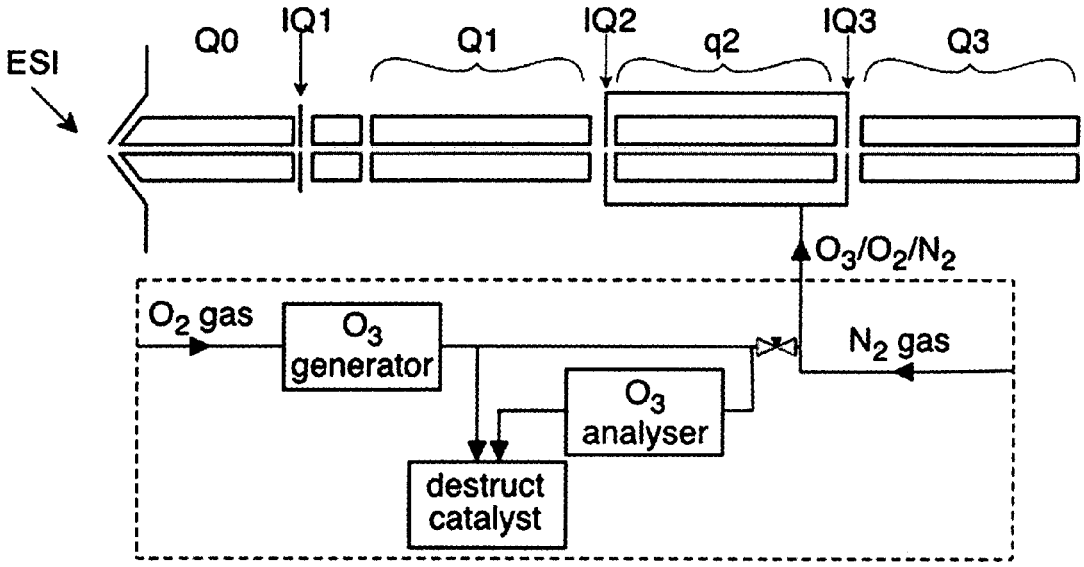
FIG. 2 is a schematic diagram of a prior art mass spectrometer system modified to perform ozone-induced dissociation.

A shown in FIG. 2, a sample to be analyzed (for example, a mixture of lipids or fatty acids) is introduced into the mass spectrometer (110). Positive or negative ions of the sample are generated in the source, by, for example electrospray, electron impact or chemical ionization, or any other method that produces ions of the sample (120). The ions may be $[M+H]^+$, $[M+Li]^+$, $[M+Na]^+$, [M−H], or any other suitable ions. Ions having mass-to-charge ratios within a selected Transmission window are mass selected by, for example, a quadrupole (130). This window can be narrow (e.g., 1-2 mass-to-charge units wide) or broad (e.g., 20-30 mass-to-charge units wide). The ions can then react with ozone in an ion/molecule reaction region (140). Where the mass analyzer is capable of facilitating reaction of the selected ions with ozone (e.g., a quadrupole ion trap), the ions may be both mass selected and reacted with ozone in this component of the mass spectrometer.

Where a separate mass analyzer, such as a quadrupole, which can precede the ion reaction region is employed, the ions can be mass selected by the quadrupole (130), and then conveyed to the ion/molecule reaction region (140) (e.g., an ion trap) where reaction with ozone takes place. In this illustrative embodiment, the ozone can be introduced into the reaction chamber (140) without using a buffer gas, or with any other unreactive buffer gas such as oxygen, helium, nitrogen or argon. The fragment ions resulting from the reaction of the mass selected ions with ozone are mass analyzed and detected and a spectrum is obtained. The position of any CCDBs is then determined based on the difference between the mass-to-charge ratio of the ions selected using the aforementioned quadrupole (130), and the mass-to-charge ratio of one or more of the ozone-induced dissociation fragment ions. Determination of the number of and position of CCDBs based on the ozone-induced dissociation fragment ions is well established in the art and is described in more detail in U.S. Pat. No. 7,711,943 to Blanksby et al., which disclosure is hereby incorporated by reference in its entirety.

By performing the ozonolysis reaction on mass-selected ions, it is now possible to unambiguously determine the number of and position of CCDB-containing compounds present in complex mixtures. This is based on the fact that the mass-to-charge ratios of the chemically induced fragment ions are diagnostic of the number of and position of CCDBs within the precursor ion.

An exemplary prior art system is presented as follows. The ozone is produced by a high-concentration ozone generator (Titan 30, Absolute Systems, Edmonton, AB, Canada). High-purity oxygen is introduced into the generator at a pressure of 20 psi and the generator's corona discharge current is set to 40 (arbitrary units). To ensure stable ozone concentration, the generator is run for at least 30 min prior to data collection. An inline ozone analyser (Mini HiCon; InUSA Inc., Norwood, Mass., USA) is used to measure the ozone content of the Oxygen/ozone gas mixture being introduced to the instrument. Typical ozone content is 140-160 g/m$^3$ (ca. 11-12% $O_3$ in $O_2$ by mass) at a flow rate of 300-400 mL/min. The ozone/oxygen gas mixture is injected into the main nitrogen CID gas line through a T-junction, while excess ozone is destroyed by commercial ozone destruct units (InUSA Inc.). Since ozone is a corrosive gas, all tubing used to construct the gas manifold and ozone delivery system is either 316 stainless steel or Teflon. As shown in FIG. 2, establishing a working pressure of ozone in q2 requires large-scale ozone generator—an inefficient use of resources. In addition, all of the ozone is produced outside the vacuum chamber of the mass spectrometer—this poses a hazard & health risk (i.e., extra safety precautions must be followed).

However, ozone can be generated in situ for the purposes of performing OzID experiments in a mass spectrometer. In some embodiments, the improved method and apparatus can be implemented using a modified QTRAP® mass spectrometer, as illustrated by FIG. 3.

Figure 3:
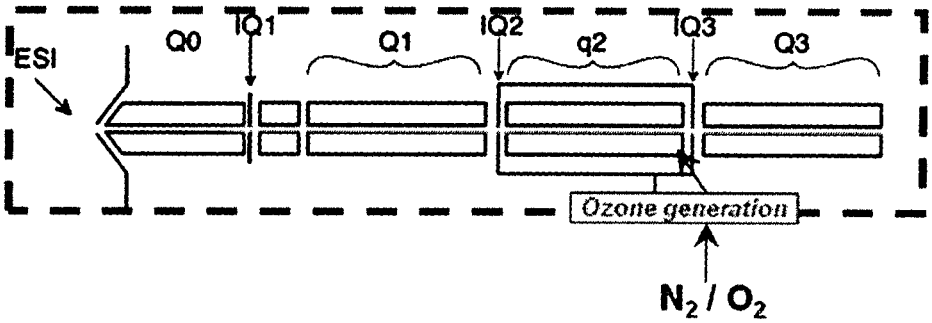
FIG. 3 is a schematic diagram of a mass spectrometer system capable of performing ozone-induced dissociation according to the applicants' teachings.

More specifically, in FIG. 3, in a mass spectrometer (200) such as a QTRAP®, the analyzer can comprise three regions, quadrupole 1 (q1) (210), quadrupole 2 (q2) (220) and quadrupole 3 (q3) (230), which are generally positioned in order along the length of the mass spectrometer and are generally all located within a high vacuum chamber. Two of the elements, quadrupole 1 (q1) and quadrupole 3 (q3) are used to separate ions based upon their m/z ratio. They are normally held at ~$10^{-5}$ Torr. The third element labeled, quadrupole 2 (q2), is an rf-only ion guide that is used to fragment ions. This can be used for structure elucidation. In some embodiments, the pressure here can be ~$10^{-3}$ Torr. Ions pass through the length of the mass spectrometer and are detected after passing through q3. As depicted in FIG. 3, the illustrated system provides localized ozone generation within q2 using an ozone generator (240) within the vacuum chamber. The ozone generation may be performed using any number of known methods. In one embodiment, the ozone generation is by corona discharge.

By way of example, along a gas flow path, in some embodiments, an open-ended corona discharge tube can be installed that, during "standard" operation, would remain inactive (i.e., no discharge initiated). In one embodiment the gas is a CAD gas which would flow unaltered over this assembly. To generate ozone in situ during an OzID experiment, oxygen would be added to the CAD gas and the corona discharge would be initiated. This will generate ozone that will be carried into the q2 region for use in OzID reactions. A working pressure of less than a few mTorr of ozone is achieved in q2 using a much smaller ozone generator, located inside the vacuum chamber. Ozone generation efficiency can be lower than the large-scale generator (as the generator is much closer to the point of delivery). After delivery of ozone to the ion/molecule reaction volume, the ozone (and other residual gases) can be pumped away via high-vacuum pumps (e.g., turbomolecular pumps backed by roughing pumps). In some embodiments, only non-toxic nitrogen and oxygen are employed outside the system providing fewer safety concerns.

Figure 4:
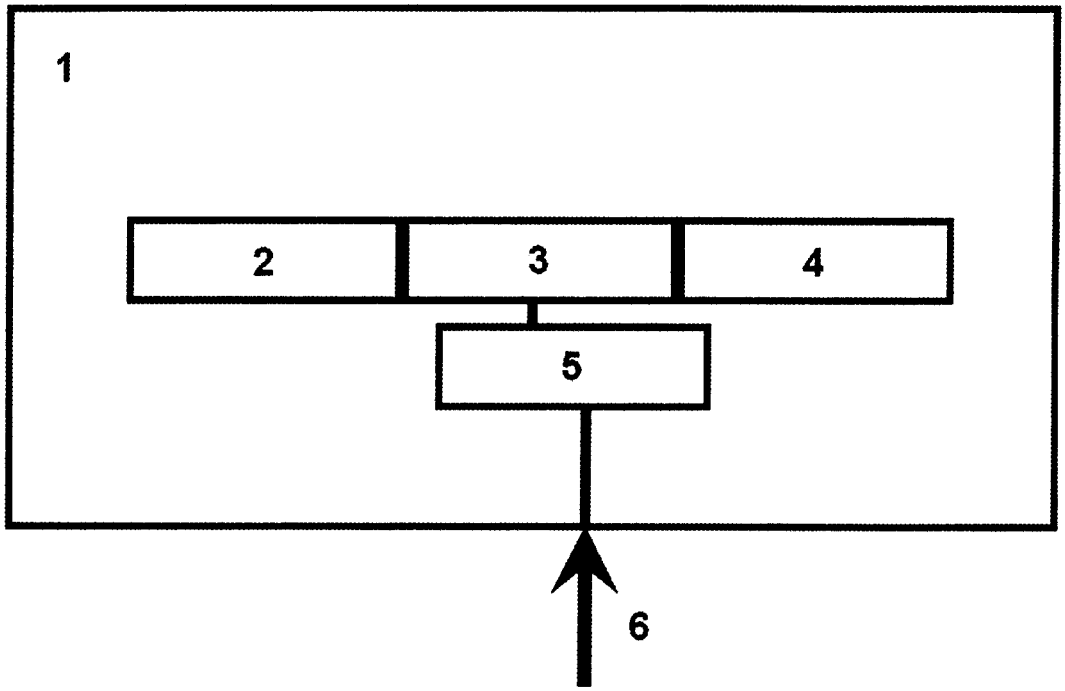
FIG. 4 is a block diagram of a mass spectrometer system capable of performing ozone-induced dissociation according to the applicants' teachings.

FIG. 4 is a schematic diagram of an embodiment of the mass spectrometer system according to the present teachings. The mass spectrometer (300) comprises: a first mass spectrometer element (310); a second mass spectrometer element (320); an ion/molecule reaction volume disposed between said elements (330); an ozone generator (340); and a gas source (350) capable of introducing a gas mixture containing a partial pressure of oxygen to said ozone generator, wherein the first element, the second element the reaction volume and the ozone generator are all housed in a high vacuum chamber and wherein the gas source is housed outside of the high vacuum chamber.

FIG. 5 schematically depicts a collision cell 400 in a mass spectrometer according to the present teachings in which ozone can be generated in situ within the collision cell. A conduit 401 extends from a proximal end 401*a* to a distal end 401*b* that is fluidly coupled to the collision cell 400 to deliver gas thereto. An externally located source for CAD gas 402 as well as a source 404 for providing an ozone precursor gas are coupled to the proximal end of the of the conduit 401. An electrically conductive wire 406 is disposed within the conduit and extends from a proximal end, which is electrically coupled to a voltage source 408, to a distal end that comprises an exposed tip that is disposed within the collision cell. In use, the ozone precursor gas can be delivered to the conduit to flow to the collision cell, either by itself or as a mixture with the CAD gas. A voltage can be applied to the wire to generate a corona discharge in the vicinity of its exposed tip within the collision cell to convert the ozone precursor gas, via exposure to the corona discharge, to ozone in situ within the collision cell. In some embodiments, subsequent to in situ generation of ozone within the collision cell, the discharge can be extinguished and the spectrometer can be use to analyze fragment ions generated by ozonolysis.

In some embodiments, the use of in situ ozone generation can dramatically reduce the cost-structure of the OzID workflow, eliminating the need for a commercial/industrial-sized ozone generator, ozone-gas detection systems, and all other safety precautions required while using ozone in an open-air lab environment.

Also, the efficiency of transfer for ozone would be higher in an "in situ" workflow than in the conventional configurations, which typically require the externally generated ozone to traverse several meters of gas lines before arriving at the q2 reaction region.

Aside from the improved safety of this ozone generation technique, the in situ ozone generation technology would be far less cumbersome and much less expensive for an end-user to operate and maintain.

The method can be performed using any type of trapping mass spectrometer (e.g., ion-trap or ion cyclotron resonance) or any tandem mass spectrometer (e.g., quadrupole-time of flight, triple quadrupole or selected ion flow tube) that can provide sufficient residence time for ions to undergo reaction with ozone.

The section headings used herein are for organizational purposes only and are not to be construed as limiting the subject matter described in any way. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. A mass spectrometer system comprising:

(i) means for ionizing the compound to provide ions;

(ii) means for selecting ions of a given mass-to-charge ratio;

(iii) means for allowing the selected ions to react with ozone to give ozone-induced dissociation fragment ions;

(iv) means for mass analyzing and detecting the ozone induced fragment ions formed in step (iii); and (v) means for determining the number of and position(s) of any carbon-carbon double bonds in the compound based on the difference between the mass-to-charge ratio of the ions selected by the ion selection means, and the mass-to-charge ratio of one or more of the ozone-induced dissociation fragment ions formed from the selected ions formed by the reaction means;

wherein the ozone is generated within the vacuum chamber of the mass spectrometer system, at or near the ion/molecule reaction region where reactions between ions and ozone can take place.

2. A mass spectrometer comprising:

(i) a first mass spectrometer element;

(ii) a second mass spectrometer element;

(iii) an ion molecule reaction volume disposed between said elements;

(iv) an ozone generator; and (v) a gas source capable of introducing a gas mixture containing a partial pressure of oxygen to said ozone generator;

wherein the first element, the second element, the reaction volume and the ozone generator are all housed in a high vacuum chamber and wherein the gas source is housed outside of the high vacuum chamber.

3. The mass spectrometer of claim 1 or 2 wherein the ozone generator operates via corona discharge.

4. A method for determining the number of and position of carbon-carbon double bonds in a compound, the method comprising: (i) ionizing the compound to provide ions; (ii) selecting ions of a given mass-to-charge ratio; (iii) allowing the selected ions to react with ozone to give ozone-induced dissociation fragment ions; (iv) performing mass analysis and detection of the ozone-induced dissociation fragment ions formed in step (iii); and (v) determining the number of and position of any carbon-carbon double bonds in the compound based on the difference between the mass-to-charge ratio of the ions selected in step (ii), and the mass-to-charge ratio of one or more of the ozone-induced dissociation fragment ions formed from the selected ions in step (iii), wherein the ozone is generated within a high vacuum chamber housing that also houses the ion/molecule reaction chamber.

5. The method of claim 4 wherein the ozone is generated by corona discharge.

6. A mass spectrometer comprising a collision cell, a conduit for delivering an ozone precursor to said collision cell from a source external to the collision cell, a device for generating a corona discharge within a region of said collision cell so as to convert said ozone precursor into ozone in situ within said collision cell.

* * * * *